United States Patent [19]

Long et al.

[11] Patent Number: 4,964,441

[45] Date of Patent: Oct. 23, 1990

[54] FOAM CLEANER FOR LOOM REEDS

[75] Inventors: Wayne H. Long, Anderson; Francis M. Wardlaw, Jr., Honea Path, both of S.C.

[73] Assignee: Milliken Research Corporation, Spartanburg, S.C.

[21] Appl. No.: 393,892

[22] Filed: Aug. 15, 1989

[51] Int. Cl.[5] ..... D03D 49/00

[52] U.S. Cl. ..... 139/1 C; 134/26; 15/302

[58] Field of Search ..... 15/310, 306 R, 303, 15/302, 312 R, 246; 134/26, 25.5, 10; 139/1 C

[56] References Cited

U.S. PATENT DOCUMENTS

| | | | |
|---|---|---|---|
| 3,079,285 | 2/1963 | Rockwell . | |
| 3,538,535 | 11/1970 | Ginsburgh et al. | 15/302 |
| 3,751,755 | 8/1973 | Smith . | |
| 3,874,022 | 4/1975 | Wogoman et al. . | |
| 4,527,596 | 7/1985 | Kagi . | |
| 4,640,316 | 2/1987 | Wakai | 139/1 C |
| 4,653,543 | 3/1987 | Brown | 139/1 C |
| 4,676,277 | 6/1987 | Gillespie et al. | 139/1 C |
| 4,817,646 | 4/1989 | Brooks . | |
| 4,895,186 | 1/1990 | Shaw | 139/1 C |

*Primary Examiner*—Andrew M. Falik

*Attorney, Agent, or Firm*—Earle R. Marden; H. William Petry

[57] ABSTRACT

Method and apparatus to clean the reeds of a weaving machine without removing the reeds from the machine and without disconnecting the warp yarns. A cleaning head is slid down the reed and blows a foaming agent through the space between the dents of the reed and sucks the lint, dust, etc. dislodged by the foaming agent back through the spaces between the dents and directs such to a point of collection.

4 Claims, 3 Drawing Sheets

FOAM CLEANER FOR LOOM REEDS

This invention relates generally to the cleaning of loom reeds and in particular to the cleaning of air jet loom reeds while in position on the loom without disengaging the warp yarn therefrom.

It is necessary for efficient operation of a weaving machine to clean the lint, finish, etc. from on and between the dents of a loom reed. This, in the past has been accomplished in numerous ways, none of which are completely satisfactory. The obvious and old fashioned way to clean the reed was to disengage the warp yarns and remove the reed to a remote position for cleaning. This was very time consuming and inefficient. Some practical systems such as leaving the reed in the loom and blowing or ultrasonically treating the reed in situ have been tried but do not perform the necessary cleaning in the most efficient manner.

Therefore, it is an object of this invention to provide an apparatus and method to efficiently clean the reed of a weaving machine in situ without disengaging the warp yarns therefrom.

Other objects and advantages of the invention will become readily apparent as the specification proceeds to describe the invention with reference to the accompanying drawings, in which.

Figure 2:
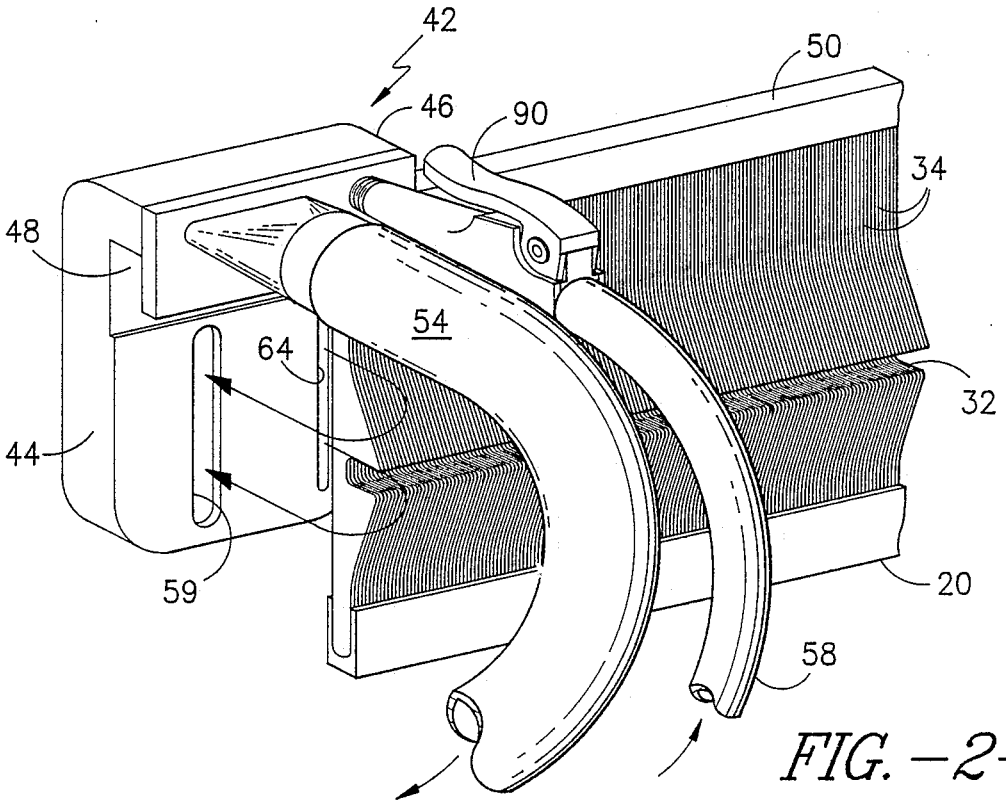
FIG. 2 is a perspective view of a portion of the reed used in the weaving machine of FIG. 1.
Figure 3:
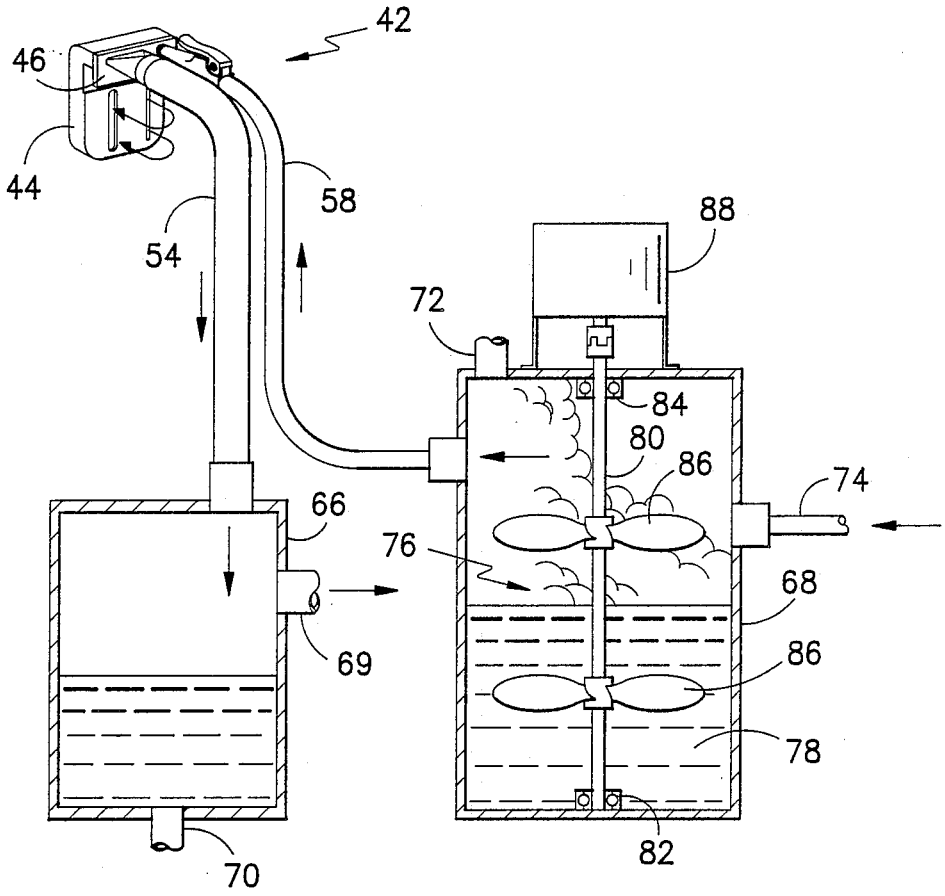
FIG. 3 is a schematic representation of the system used to operate the reed cleaner shown in the reed in FIG. 2.
Figure 4:
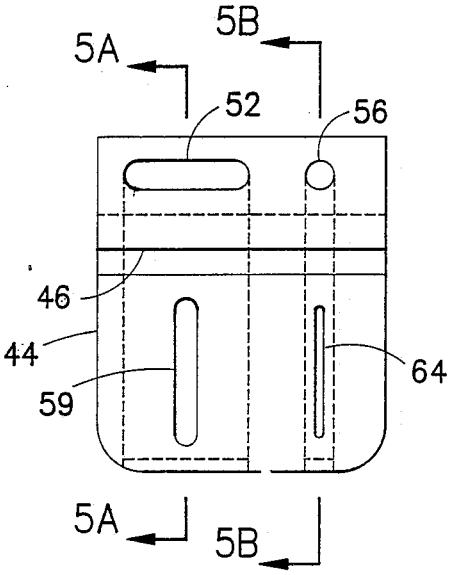
Figure 5A:
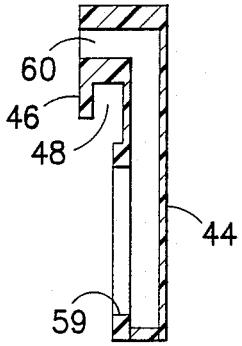
Figure 5B:
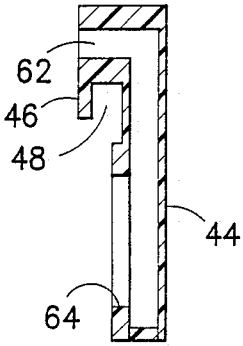

FIGS. 4 and 5 (*a*) and (*b*) are front and cross-section views, respectively, of the reed cleaning head shown in FIGS. 2 and 3.

Figure 6:
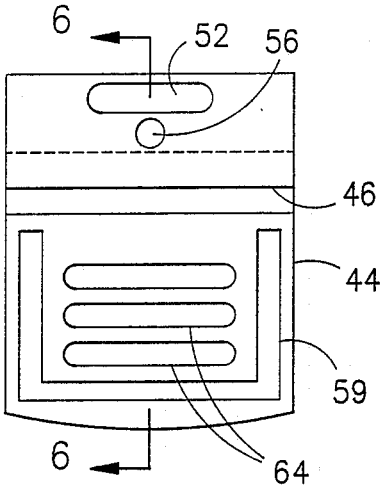
Figure 7:
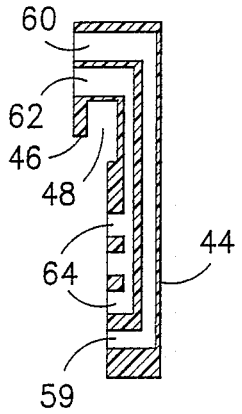
Figure 8:
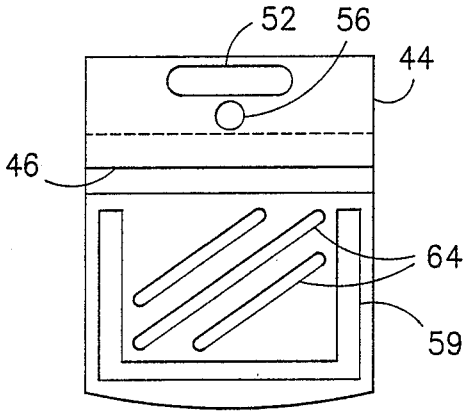

FIGS. 6 and 7 show a modification of the cleaning head of FIGS. 4 and 5, and FIGS. 8 to 11 are further modifications of the reed cleaning head.

In the preferred form of the invention the reed cleaning apparatus is disclosed in conjunction with an air jet weaving machine with the warp yarns located in weaving position but obviously the herein-disclosed system could be used on water jet, rapier, fly shuttle, etc. weaving machines and if desired could be used to clean reeds off-loom.

Figure 1:
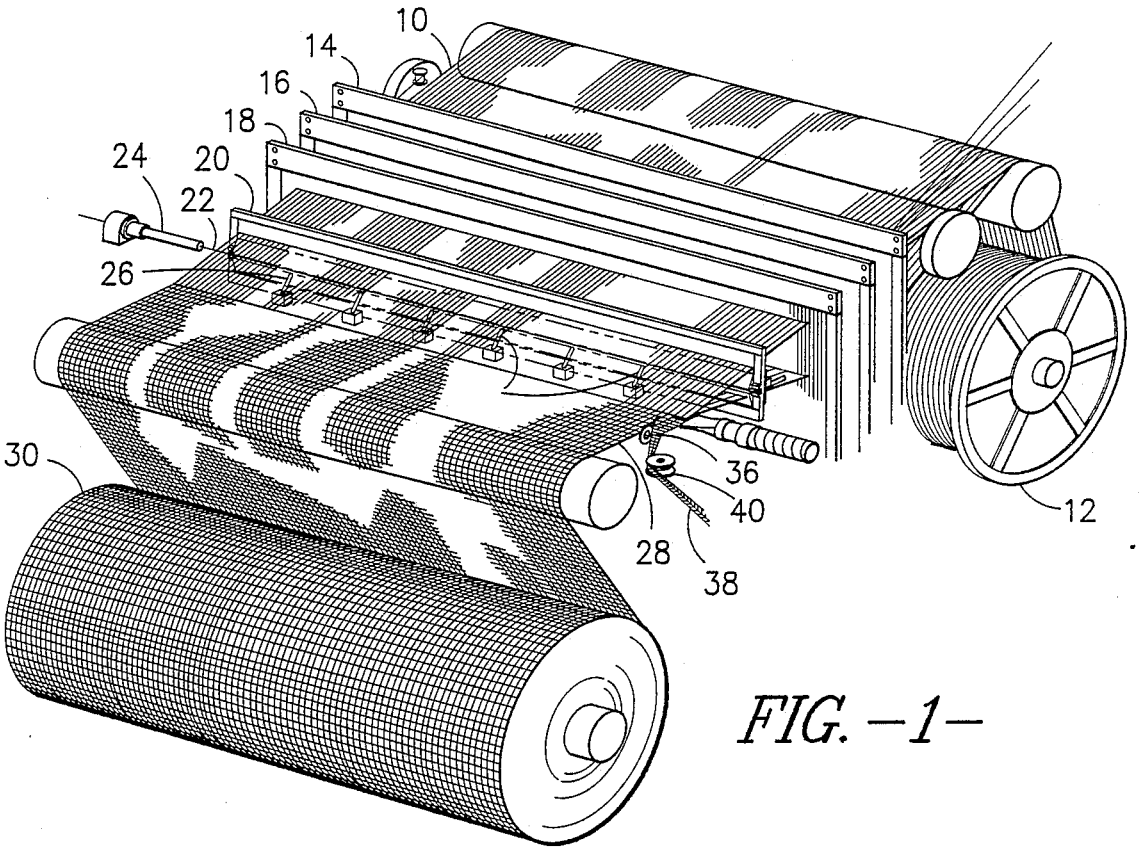
FIG. 1 is a schematic representation of a typical air jet weaving machine.

Looking now to FIG. 1 a typical air jet weaving machine or loom is shown. In typical fashion, warp yarn 10 is supplied from a warp beam 12 through a plurality of harnesses 14, 16 and 18 to the reed 20 through which the fill yarn 22 is projected by the main air nozzle 24. The fill yarn 22 is assisted in its path of travel across the lay of the loom by a series of auxiliary air jets 26. On the beat-up motion, the reed 20 moves the fill yarn 22 into position in the previously formed fabric 28 being taken up on the take-up roll 30.

The reed 20, in typical manner, has a channel or tunnel 32 formed therein by the shape of the dents 34 for the passage of the fill yarn 22 across the loom. At the remote end of the lay across from the main nozzle 24 is a cutter 36 to trim the selvage of the fabric so that the catch cord 38 can be guided away from the loom by the roll 40.

Looking now in particular to the reed cleaning system as shown in detail in FIGS. 2 and 3 with variations of the cleaning head 42 shown in FIGS. 4, 6 and 8-11.

The cleaning head 42 is manufactured from suitable material such as plastic, aluminum, etc. and has a hollow body portion 44 and a flange member 46 to form a slot 48 between it and the body portion so that the slot 48 can accommodate the channel section 50 of the reed 20. The flange 46 has an opening 52 therein to accommodate the suction line 54 and an opening 56 therein to accommodate the foam supply conduit 58. As shown in more detail in FIGS. 5 (a) and (b) the suction pressure exerted from the suction line 54 pulls through the opening 59 and cavity 60 while the foam cleaner passes into the cavity 62 and opening 64.

As shown in FIG. 3 the suction line 54 is in communication with a wet evacuator 66 and the foam supply conduit is in communication with the foam generator 68. The wet evacuator 66 is a standard unit having a conduit 69 for connection to a suction source and a drain valve 70 to clean out the accumulated liquid, etc. collected therein. The foam generator 68 is also a standard unit having an inlet conduit 72 for an aqueous solution of anionic surfactant to be foamed, a compressed air inlet 74 and an agitator 76 to foam the aqueous solution of anionic surfactant. The agitator 76 basically consists of a rotable shaft 80 mounted in suitable bearings 82 and 84 with fan blades 86 fixed thereto which are rotated with the shaft 80 when driven by motor 88 mounted on top of the foam generator 68.

OPERATION

When it is time to clean the reed of a particular weaving machine or loom, a cart (not shown) supporting the wet evacuator 66, foam generator 68 and cleaning head 42 is moved adjacent the selected machine and the foam generator activated to create the foam. The head 42 is then placed on the end of the reed 20 with the channel member 50 in the groove 48 causing the warp yarns 10 to be pressed downwardly by the bottom of the head 42. Then the operator depresses the handle 90 to cause the foam to be forced between the dents of the reed 20 to clean any debris such as lint, finish, dust, etc. therein. As the head 42 is moved across the reed 20 more debris is dislodged from the reed by the foam while the previously disclosed debris is pulled back through the space between the dents 34 into the opening 59 and thence to the wet evacuator 66. This action is kept until the operation has slid the cleaning head 42 all the way across the reed 20 to complete the cleaning thereof.

Figure 9:
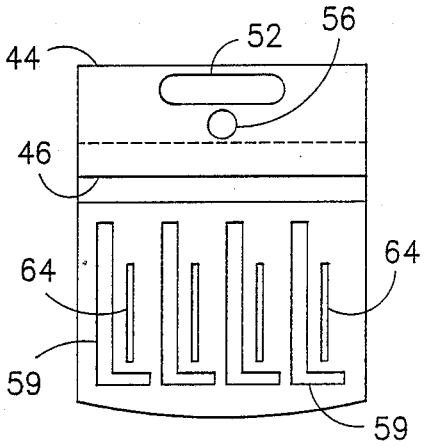
Figure 10:
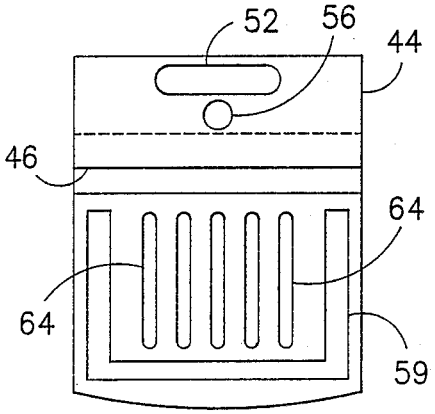
Figure 11:
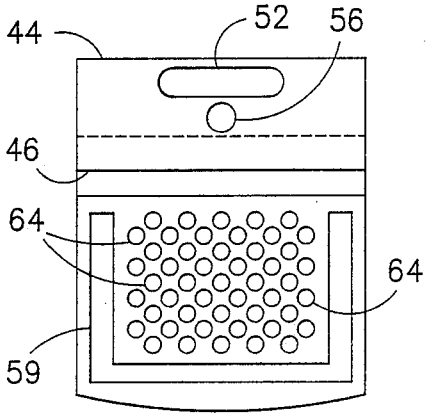

FIGS. 6–11 show variations of the suction openings and foam openings which can be used to spread the cleaning action on the reed rather than the one shot approach illustrated in FIGS. 4 and 5 wherein the openings are substantially vertical and act on only one dent spacing at a time. FIG. 9 is generally similar to this action except the number of openings are repeated while FIGS. 6, 7, 9, 8–10 tend to spread the cleaning action as well as the suction return of the dislodged debris.

As can readily be seen the herein disclosed method and apparatus allows the reeds to be efficiently cleaned in situ on the weaving machine without disconnecting the warp yarns. The cleaning system provides for cleaning of the reeds and instantaneous removal of the debris and/or material removed from and between the dents.

Although we have described specifically the preferred embodiments of the invention, it is contemplated that changes may be made without departing from the scope or spirit of the invention and it is desired that the invention be limited only by the scope of the claims.

We claim:

1. A method to clean the reed of a weaving machine without removing the reed from the machine comprising the steps of: placing a cleaning head on top of the top of the reed, sliding the cleaning head from one end of the reed to the other end of the reed while simultaneously blowing a foaming agent from the cleaning head through the spaces between the dents of the reed to dislodge lint, trash, etc. therefrom and sucking the dislodged lint, trash, etc. back through the spaces between the dents in the reed into the cleaning head for collection at a point of collection.

2. The method of claim 1 wherein the warp yarns are depressed by the cleaning head as it slides down the reed.

3. Apparatus to clean the reed of a weaving machine comprising: a weaving machine having a reed therein, said reed having a plurality of vertically spaced dents therein, a cleaning head slidably mounted on top of said reed, means forming a first opening in said cleaning head communicating with said dents to supply a foam cleaner therebetween, means forming a second opening in said cleaning head to apply a suction pressure between said dents, means connecting said second opening to a source of suction pressure.

4. The apparatus of claim 3 wherein said cleaning head has a groove therein to accommodate the top of said reed.

* * * * *